US007175450B1

(12) United States Patent
Lung

(10) Patent No.: US 7,175,450 B1
(45) Date of Patent: Feb. 13, 2007

(54) PORTABLE LOUDSPEAKER WITH REPLACEABLE INSERTION BASE

(76) Inventor: Chen-Tung Lung, No. 11, Alley 5, Lane 75, Jiang-Nan Ten Street, Taoyuan (TW)

( * ) Notice: Subject to any disclaimer, the term of this patent is extended or adjusted under 35 U.S.C. 154(b) by 0 days.

(21) Appl. No.: 11/403,890

(22) Filed: Apr. 14, 2006

(51) Int. Cl.
*H01R 13/62* (2006.01)

(52) U.S. Cl. ..... 439/155; 439/929

(58) Field of Classification Search ..... 439/155, 439/160, 929

See application file for complete search history.

(56) References Cited

U.S. PATENT DOCUMENTS 3,118,713 A * 1/1964 Ellis ..... 439/38
3,360,764 A * 12/1967 Bac ..... 439/155
3,374,457 A * 3/1968 Herrick ..... 439/155
4,291,931 A * 9/1981 Stupay ..... 439/155
4,558,270 A * 12/1985 Liautaud et al. ..... 320/110
4,943,703 A * 7/1990 Duxbury ..... 219/247
5,144,217 A * 9/1992 Gardner et al. ..... 320/110
5,655,916 A * 8/1997 Hayashi ..... 439/155
6,290,534 B1 * 9/2001 Sadler ..... 439/534
6,488,518 B2 * 12/2002 Mlyniec ..... 439/180
6,955,549 B2 * 10/2005 Brazell et al. ..... 439/160
6,994,575 B1 * 2/2006 Clark et al. ..... 439/173

* cited by examiner

*Primary Examiner*—Ross Gushi
*Assistant Examiner*—Larisa Tsukerman
(74) *Attorney, Agent, or Firm*—Troxell Law Office, PLLC

(57) ABSTRACT

A portable loudspeaker with a replaceable insertion base comprises: the loudspeaker; an insertion base; and a push mechanism. An insertion slot is formed on the loudspeaker for placing the insertion base. A first trench and a second trench are formed on the bottom of the insertion base in parallel with each other. A rib is formed between these two trenches. When the insertion base is coupled with the insertion slot, the hooks protrudent from the insertion slot are located to penetrate through the first trench and hook the rib, thereby inserting the terminal base of the insertion base into the socket of the loudspeaker for electrical connection. Besides, by using the push mechanism, the insertion base can be separated from the insertion slot rapidly. As a result, the insertion base can be replaced easily and it is also suitable for different digital music players.

3 Claims, 10 Drawing Sheets

PORTABLE LOUDSPEAKER WITH REPLACEABLE INSERTION BASE

FIELD OF THE INVENTION

The present invention relates to a portable loudspeaker with a replaceable insertion base, and more particularly to a replaceable insertion base that can be attached and detached rapidly.

BACKGROUND OF THE INVENTION

With the popularization of MP3 music, the Apple iPods and all kinds of MP3 players are very popular. Most MP3 players show music via the earphones when the compact size, the power consumption, and the cost are taken into consideration. In order to overcome this, the Apple Company discloses a portable loudspeaker, which is only reserved for the iPod. However, this portable loudspeaker is not suitable for other music player different from the Apple iPod.

Another conventional portable loudspeaker with a replaceable insertion base, which is suitable for different MP3 music player, is disclosed. In this portable loudspeaker, respective terminal bases, which are suitable for all kinds of MP3 players, are mounted on the insertion bases. As a result, the user can select a required terminal base and replace the insertion base as well. However, the insertion base is typically screwed onto the portable loudspeaker so the conventional insertion base cannot be replaced without the use of auxiliary tools. As a result, for the user, it is very inconvenient. Besides, for the manufacturers, the additional cost of locking device is unavoidable and its assembly takes a certain period of time so it cannot fulfill the economic benefits.

SUMMARY OF THE INVENTION

It is a main object of the present invention to provide a portable loudspeaker with a replaceable insertion base, wherein the insertion base can be replaced easily to be suitable for different digital music players such that its assembly is more power-saving and time-saving.

DETAILED DESCRIPTION OF THE PREFERRED EMBODIMENT

Figure 1:
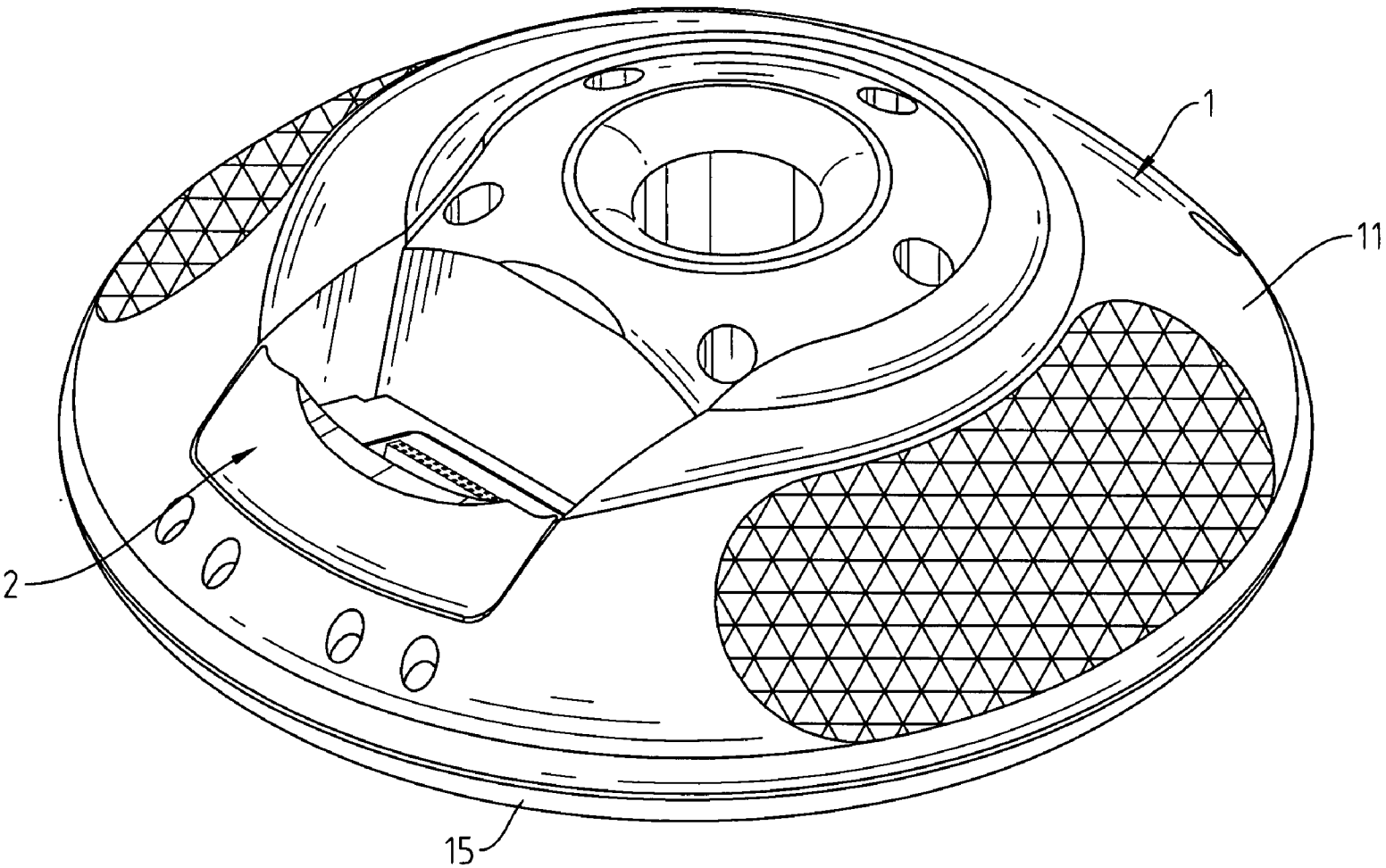
FIG. 1 is a three-dimensional view of the present invention.
Figure 2:
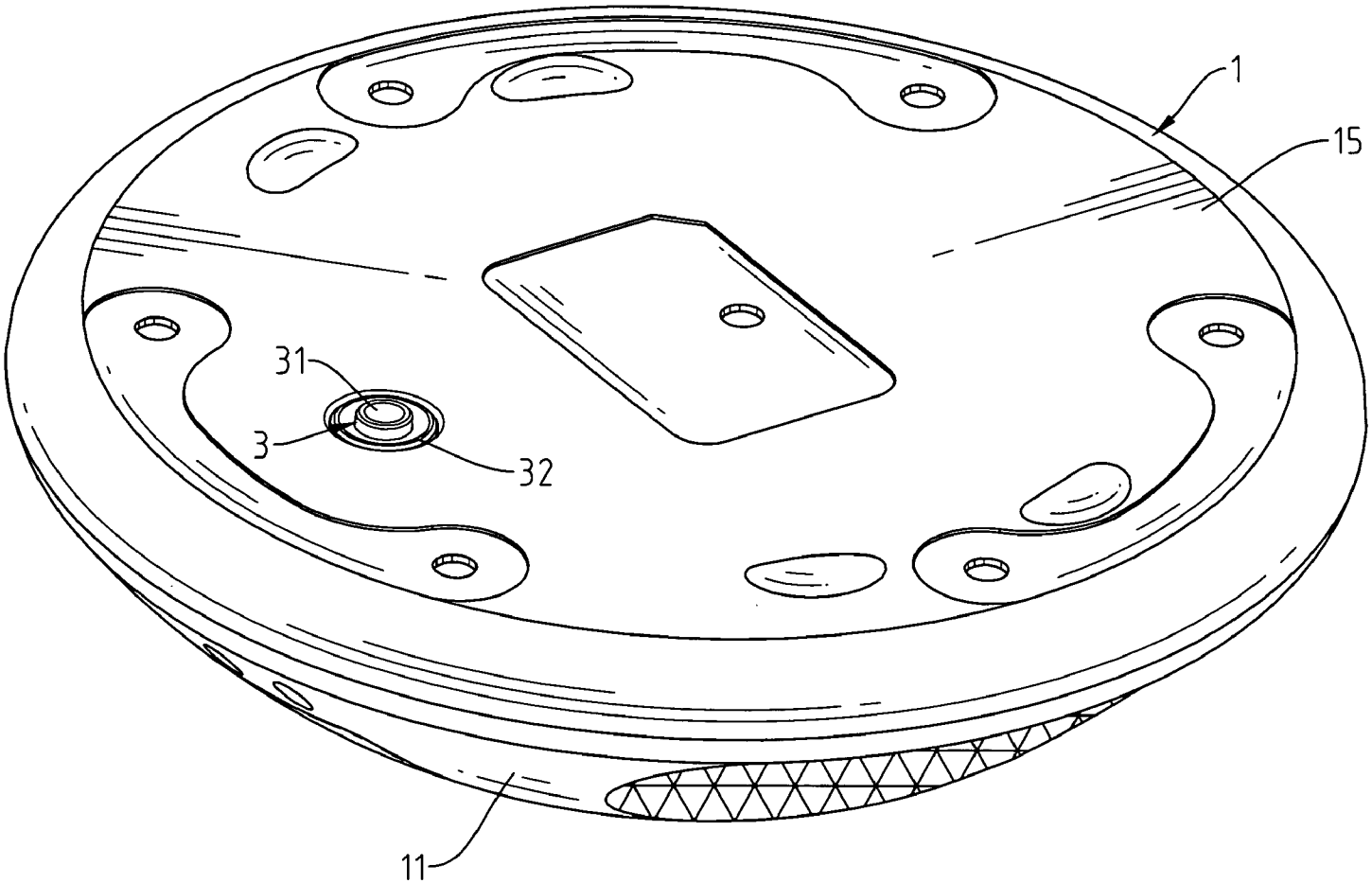
FIG. 2 is a three-dimensional rear view of FIG. 1.
Figure 3:
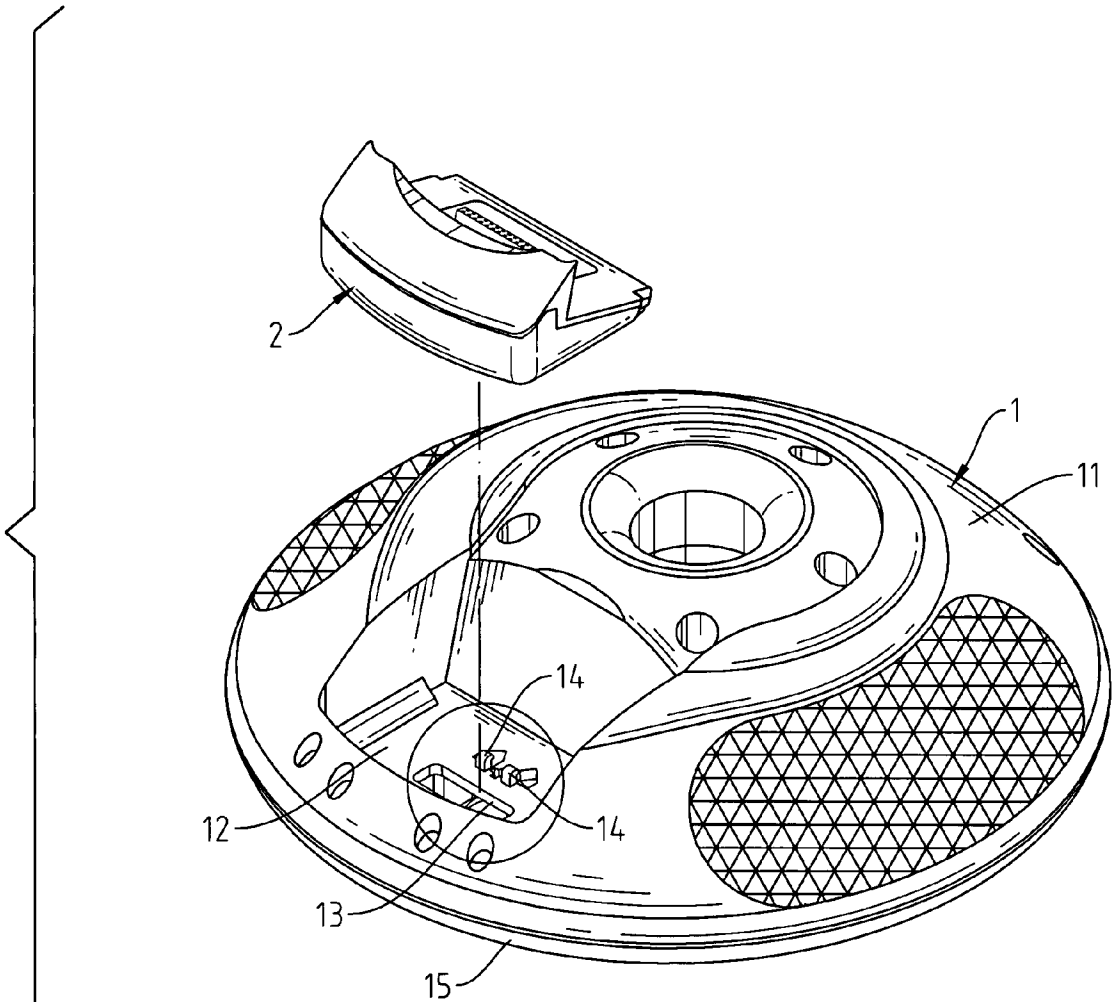
FIG. 3 is a schematic assembled view showing the portable loudspeaker and the insertion base of the present invention.
Figure 4:
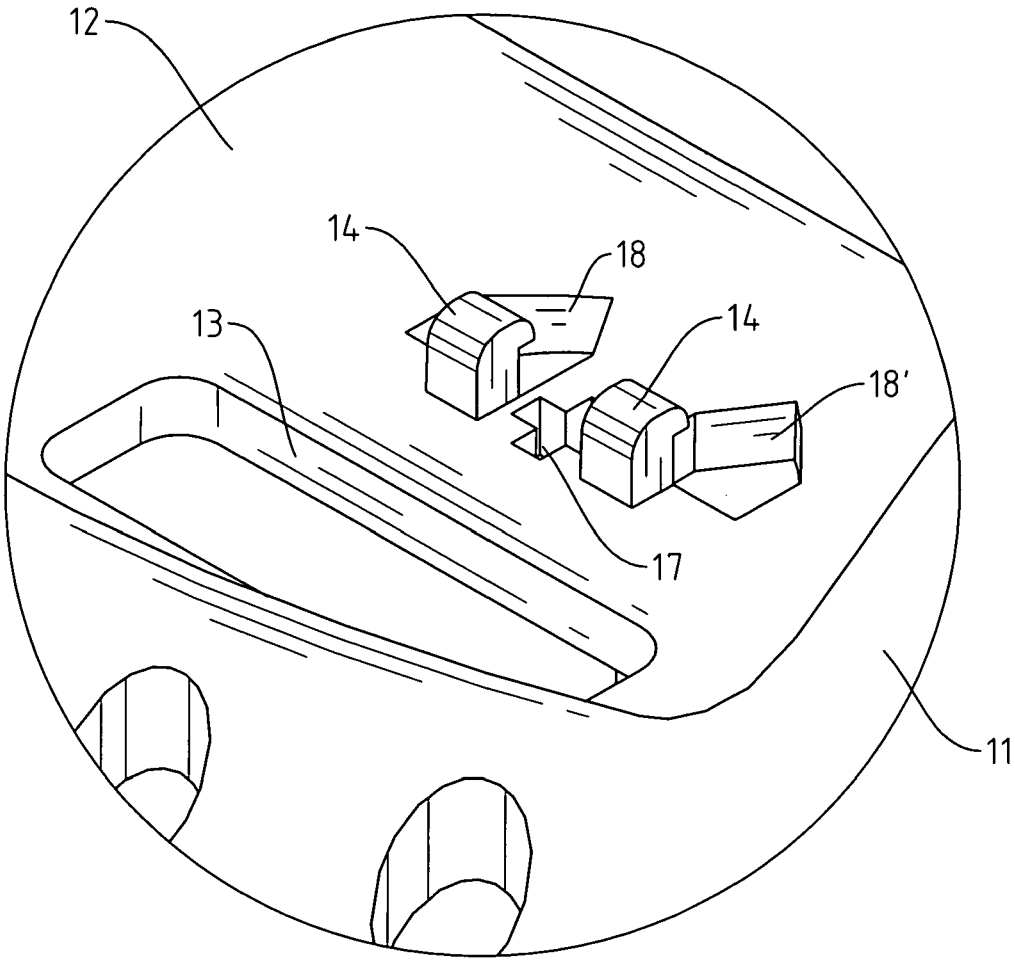
FIG. 4 is a partial enlarged view of an encircled region in FIG. 3.
Figure 5:
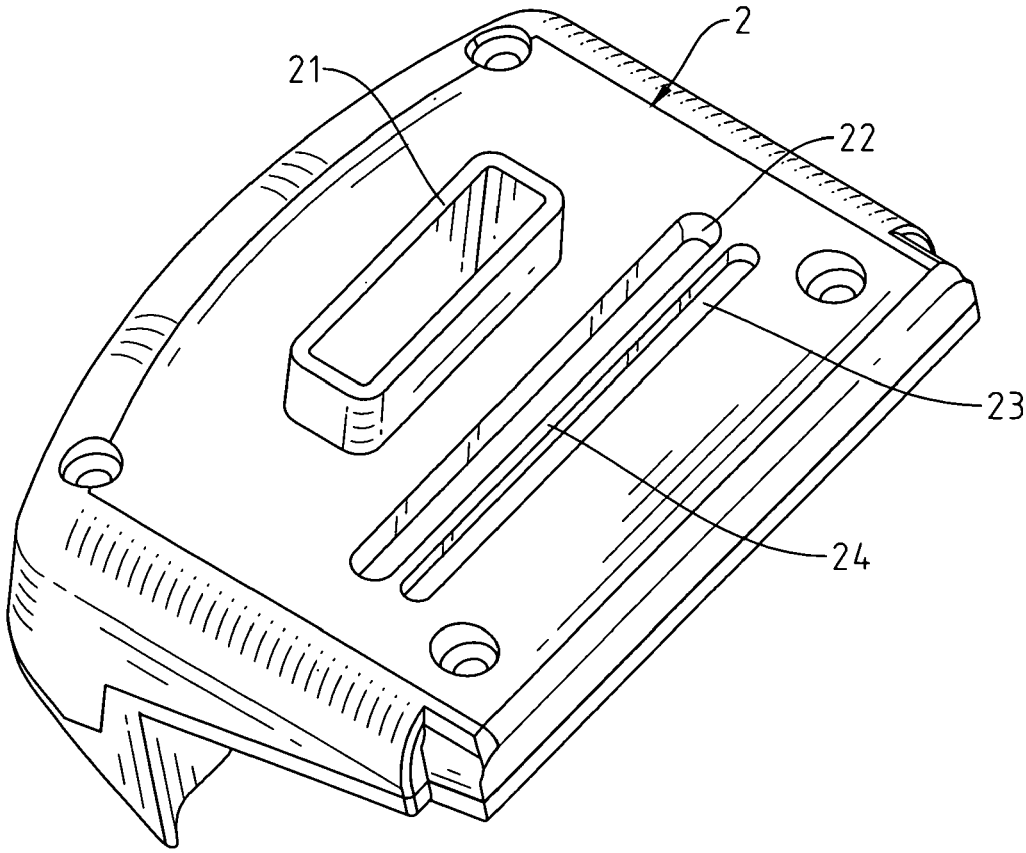
FIG. 5 is a three-dimensional rear view of the insertion base of the present invention.
Figure 6:
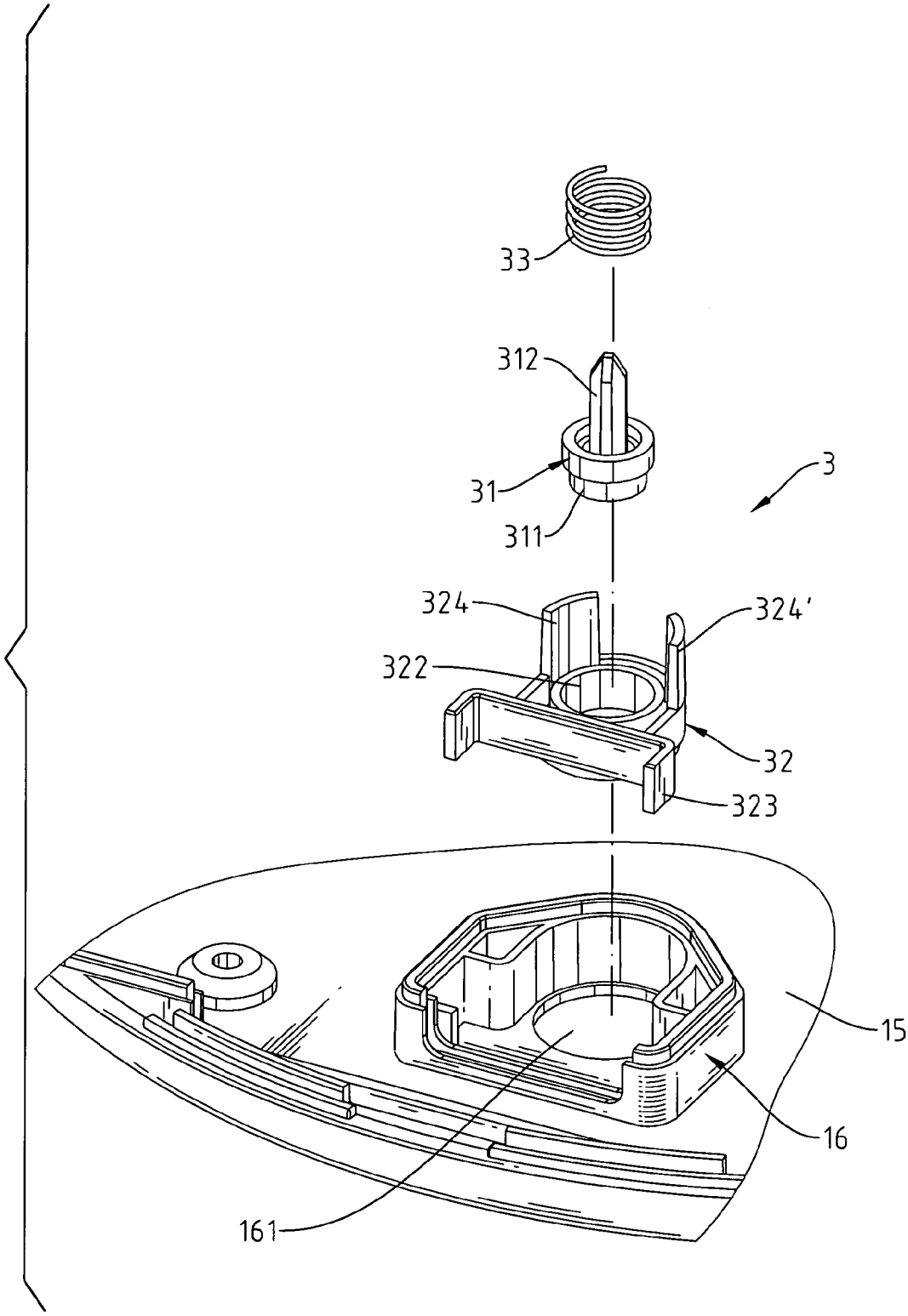
FIG. 6 is a schematic assembled view showing the push mechanism and the portable loudspeaker of the present invention.
Figure 7:
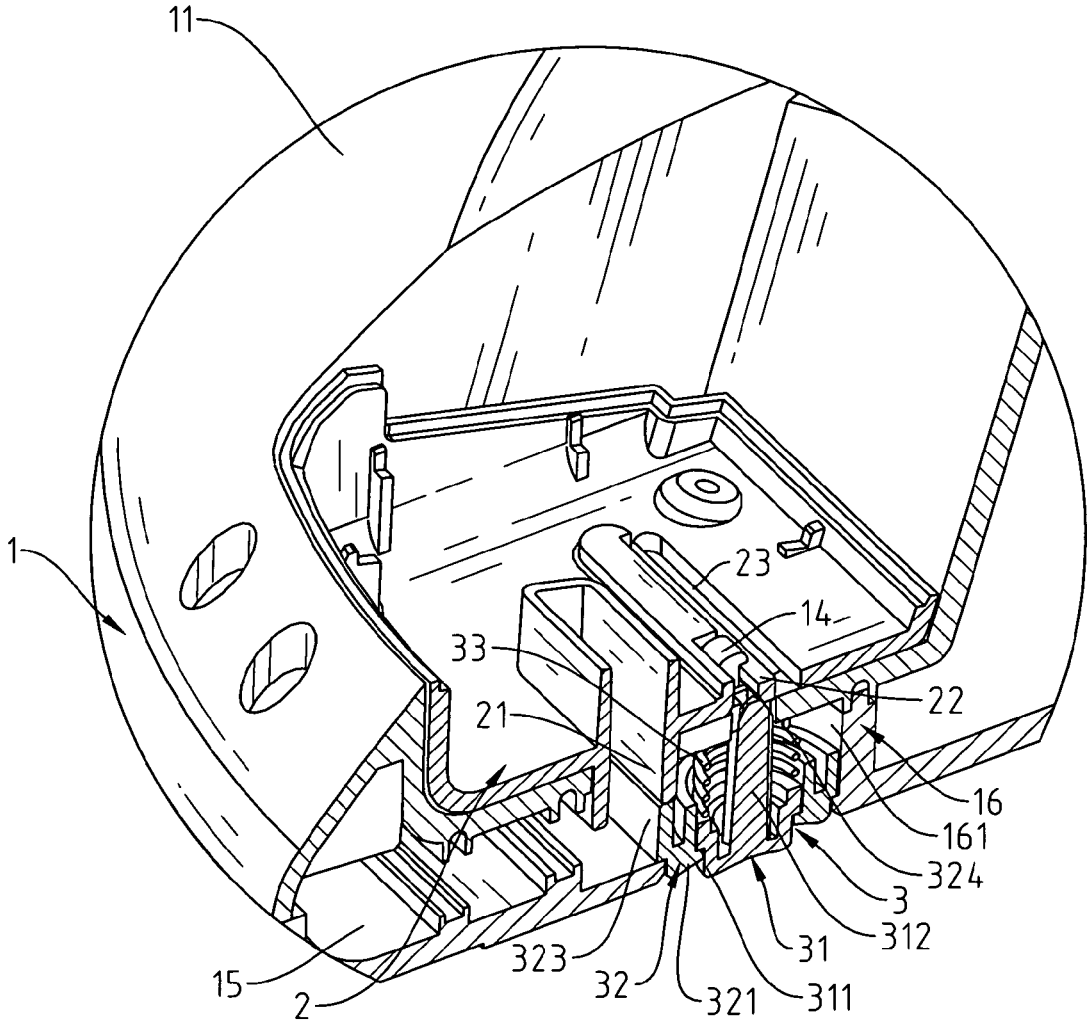
FIG. 7 is a partial enlarged, cross-sectional, three-dimensional view of FIG. 4.

Referring to FIG. 1 through FIG. 7, a replaceable insertion base for use in a portable loudspeaker is shown. A recessed insertion slot 12 is mounted in the front of an upper shell 11 of the portable loudspeaker 1 for placing the insertion base 2, as shown in FIG. 3. Besides, a chamber is formed between the insertion base 2 and the upper shell 11 for placing a digital music player, as shown in FIG. 1, wherein a rectangular opening 13 is formed in the insertion slot 12 and two resilient flexible hooks 14 are mounted oppositely above the opening 13. Two through holes 18 and 18' are formed on one side of the hooks 14, respectively. A cross-shaped opening 17 (shown in FIG. 4) is formed between the hooks 14. A terminal base 21 is formed on the insertion base 2 and protrudent from upper and lower surfaces thereof, as shown in FIG. 3 and FIG. 5. In addition, on the bottom surface of the insertion base 2, first bar-shaped trench 22 and second bar-shaped trench 23 are formed in parallel with each other. Besides, as shown in FIG. 5, a rib 24 is formed between these two trenches. When the insertion base 2 is coupled with the insertion slot 12, the bottom of the terminal base 21 is allowed to penetrate through the opening 13 for inserting into a socket (not shown) of the loudspeaker 1 electrically, securely by using an insertion terminal of the terminal base 21 so as to form a communication interface between the digital music player and the loudspeaker. At the same time, the hooks 14 are located to penetrate through the first trench 22 for securely locking the rib 24, as shown in FIG. 6 and FIG. 7.

In addition, the coupled insertion base 2 and insertion slot 12 may be detached from each other by a push mechanism. Referring again to FIG. 6, the push mechanism 3 comprises a first push device 31, a second push device 32, and a recovering spring 33, which are assembled to each other in sequence and embedded into an reception base 16 of a lower shell 15 of the portable loudspeaker 1, wherein they are not protrudent to the outside of the bottom of the portable loudspeaker 1, as shown in FIG. 2. Besides, the push mechanism 3 is raised gradually in two stages by pressing the first push device 31 and the second push device 32 so as to separate the insertion base 2 from the insertion slot 12 rapidly for easy replacement.

Detailedly speaking, the reception base 16 has a chamber conformal to the shape of the second push device 32 for holding it. Besides, the reception base 16 further has a reception hole 161 for pivotal coupling with a pressing part 321 located on the bottom of the second push device 32. In addition, the second push device 32 has a reception hole 322 for pivotal coupling with a pressing part 311 located on the bottom of the first push device 31. Besides, an ascending part 323, which is a U-shaped frame, and two ascending parts 324 and 324', which are arc-shaped pillars, are mounted on the second push device 32 in horizontal and vertical directions, respectively. Besides, the recovering spring 33 is in series connection with a top pillar 312 of a first push device 31, wherein the top pillar 312 is located corresponding to the cross-shaped opening 17 and has a slanted top surface. When the insertion base 2 is coupled with the insertion slot 12, the insertion base 2 and the push mechanism 3 are located to touch each other, as shown in FIG. 6.

Figure 8:
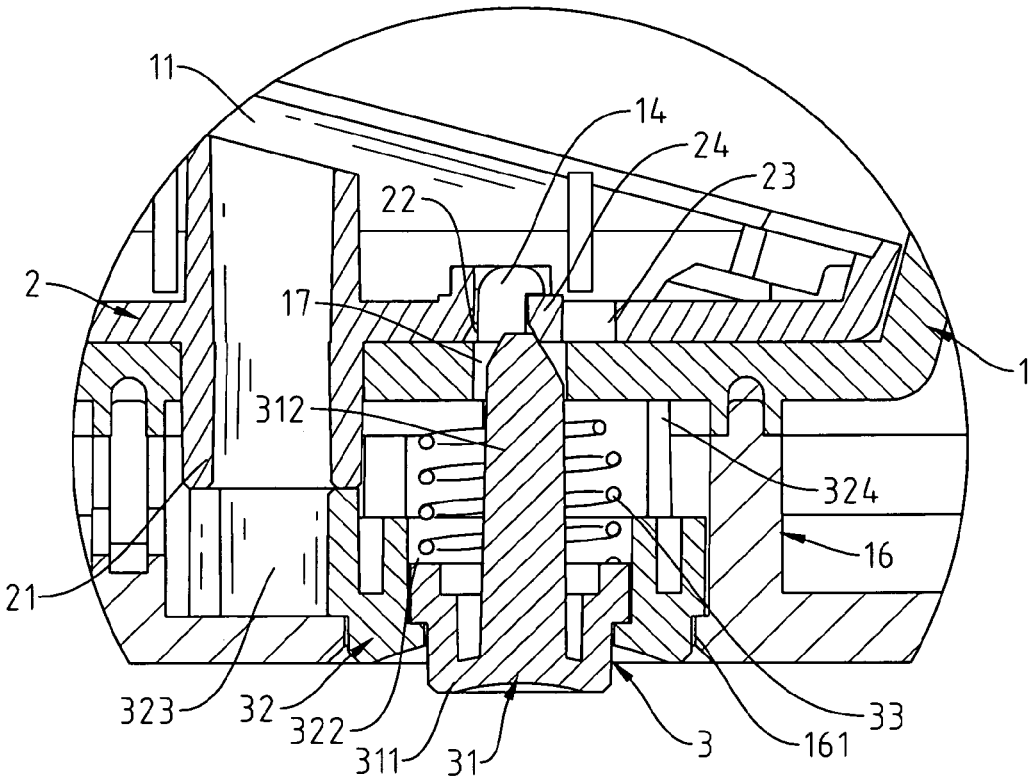
FIG. 8 is a cross-sectional view of FIG. 7.
Figure 9:
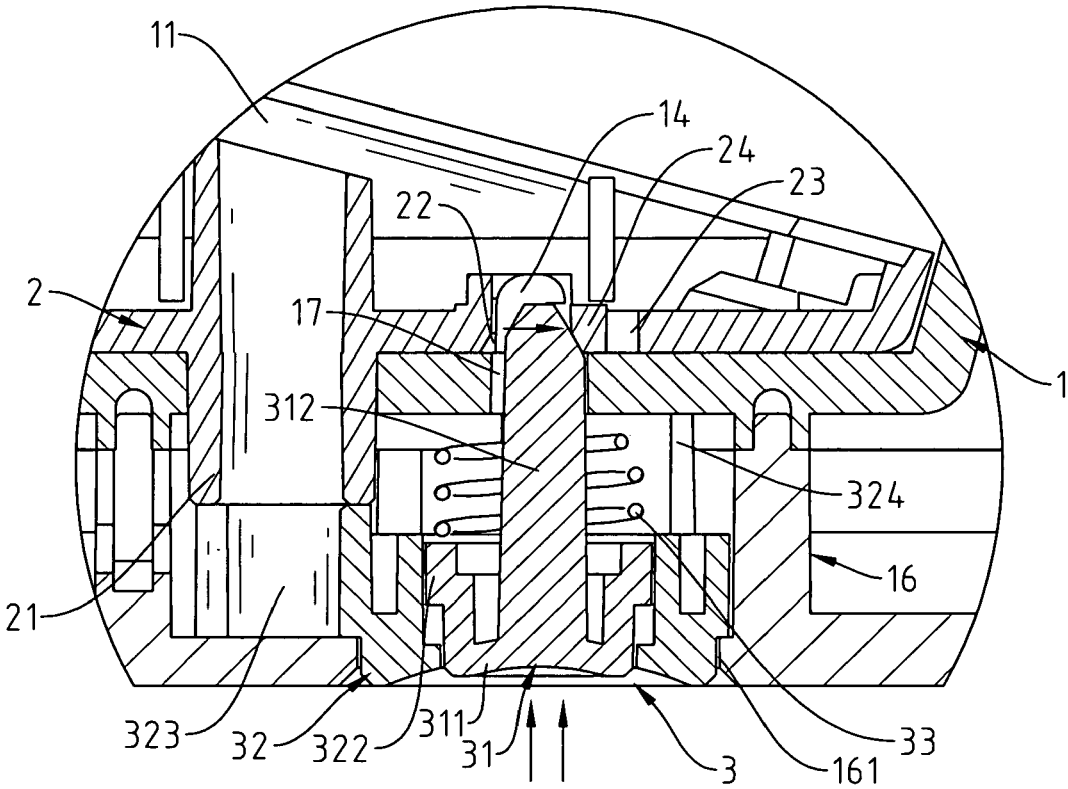
FIG. 9 is a first schematic view showing the practice of the preferred embodiment of the present invention.
Figure 10:
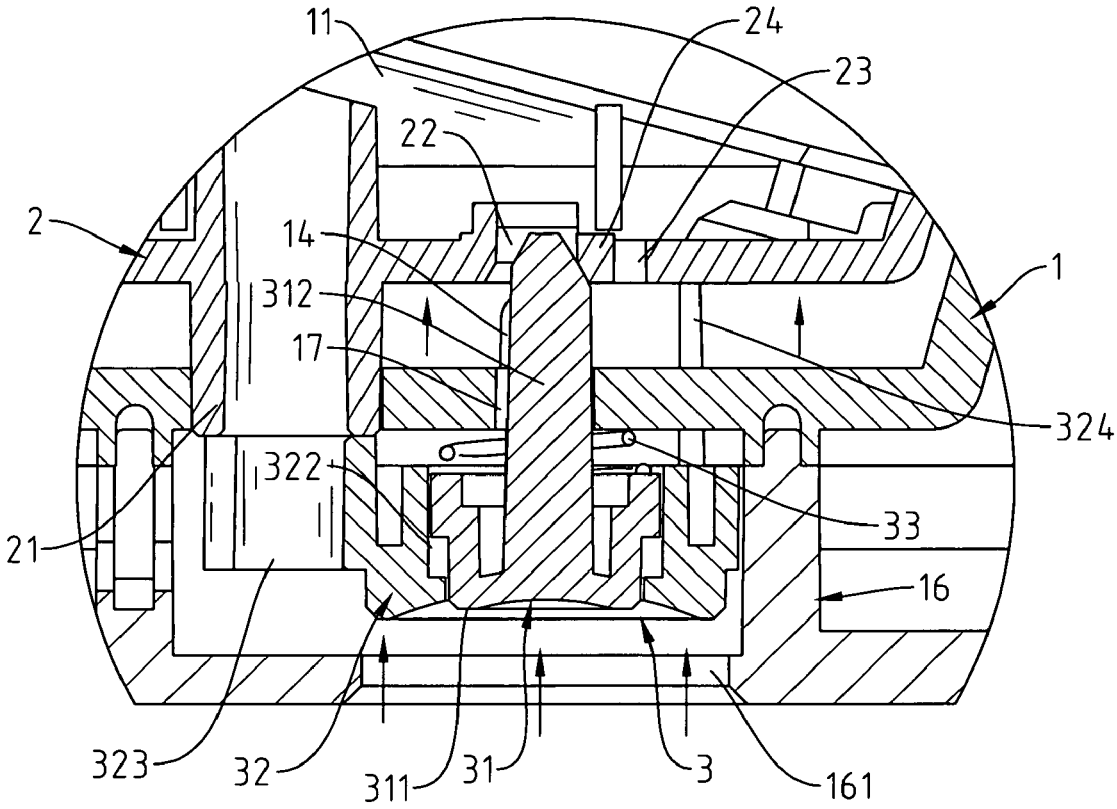
FIG. 10 is a second schematic view showing the practice of the preferred embodiment of the present invention.

Referring further to FIG. 8 through FIG. 10, since the push mechanism 3 is coupled to the reception base 16, the second push device 32 is blocked by the insertion base 2, the insertion slot 12, the hooks 14, and the rib 24 to prevent from being moved. As a result, the push mechanism 3 is pressed if there is a need to change the insertion base 2, wherein the pressing part 311 of the first push device 31 is touched first, as shown in FIG. 8, whereby the first push device 31 pushes the recovering spring 33 upward so as to enable the top pillar 312 to penetrate through the cross-shaped opening 17 and into the first trench 22 for pushing the hooks 14 upward. At the same time, the hooks 14 are shifted transversely toward the first trench 22, as shown in FIG. 9, so as to separate the rib 24 from the hooks 14. At the same time, the second push device 32 can be shifted upward by the pressing force, which is applied continuously, so as to separate the rib 24 from the hooks 14, wherein the ascending parts 324 and 324' are protrudent from the through holes 18 and 18' (shown in FIG. 4) to touch the insertion base 2, respectively, whereby the insertion base 2 (shown in FIG. 10) can be shifted upward easily by adopting the ascending parts 323, 324, and 324' as three pivots. As a result, the terminal base 21 located on the insertion base 2 is separated from the insertion slot 12 of the portable loudspeaker 1 for completing the replacement of the insertion base 2.

It is additionally mentioned that the terminal base in this preferred embodiment is, for example, a rectangular structure formed by arranged grid-shaped holes, but not limited thereto. Different insertion structures may be provided according to the utilized apparatuses. For example, the terminal base may be a combination of pin and pin socket or a combination of socket and golden finger to be suitable for different digital audio device such as Apple iPod, all types of MP3 players and mobile phones for showing music, charging, transmitting data, and acting as an amplifier of mobile phone. As a result, different types of insertion bases can be replaced with one another at any moment by using the detachable structure of the present invention and different types of terminal bases for being suitable to different digital music players easily, thereby providing the economic benefits of multiple use.

What the invention claimed is:

1. A portable loudspeaker with a replaceable insertion base comprising the loudspeaker; the insertion base; and a push mechanism, wherein a recessed insertion slot is formed on an upper shell of the loudspeaker for holding the insertion base and a reception base is formed on a lower shell of the loudspeaker, wherein a rectangular opening is formed in the insertion slot and two resilient flexible hooks are mounted oppositely above the rectangular opening, wherein a respective through hole is formed on one side of the hooks and a cross-shaped opening is formed between the hooks;

wherein a terminal base is protrudent from both sides of the insertion base, first and second bar-shaped trenches are formed on a bottom surface of the insertion base, and a rib is formed between the first and second trenches; and wherein the push mechanism comprises a first push device, a second push device, and a recovering spring embedded into an reception base of the loudspeaker, whereby the insertion base is separable from the insertion trench by pressing the first push device and the second push device.

2. The portable loudspeaker with the replaceable insertion base of claim 1, wherein a reception hole is formed on the reception base for pivotal coupling with a pressing part located on the bottom of the second push device.

3. The portable loudspeaker with the replaceable insertion base of claim 1, wherein a reception hole is formed on the second push device for pivotal coupling with a pressing part located on the bottom of the first push device and a plurality of ascending parts are mounted on the second push device in horizontal and vertical directions, respectively.

* * * * *